US009060603B1

(12) United States Patent
Christie

(10) Patent No.: US 9,060,603 B1
(45) Date of Patent: Jun. 23, 2015

(54) MODULAR CABLE WINE RACK SYSTEM

(71) Applicant: Miguel D. Christie, Atlanta, GA (US)

(72) Inventor: Miguel D. Christie, Atlanta, GA (US)

( * ) Notice: Subject to any disclaimer, the term of this patent is extended or adjusted under 35 U.S.C. 154(b) by 0 days.

(21) Appl. No.: 14/451,540

(22) Filed: Aug. 5, 2014

(51) Int. Cl.

| | |
|---|---|
| ***A47B 73/00*** | (2006.01) |
| ***A47B 43/00*** | (2006.01) |
| *A47G 23/02* | (2006.01) |
| *A47F 5/08* | (2006.01) |

(52) U.S. Cl.
CPC ..... *A47B 73/002* (2013.01); *A47B 43/006* (2013.01); *A47G 23/0208* (2013.01); *A47F 5/0892* (2013.01); *A47B 73/00* (2013.01)

(58) Field of Classification Search
CPC .... A47B 73/00; A47B 73/002; A47B 43/006; A47F 5/0892; A47G 23/0208
USPC ..... 211/74, 75, 71.01, 85.29, 113, 119; 248/317, 323, 327, 328; 108/106, 107, 108/110, 162, 163, 181, 144.11, 147.11; 206/583, 427
See application file for complete search history.

(56) References Cited

U.S. PATENT DOCUMENTS

| | | | | | |
|---|---|---|---|---|---|
| 454,259 | A | * | 6/1891 | Daniels | 108/106 |
| 719,441 | A | * | 2/1903 | Davison | 108/163 |
| 1,004,282 | A | * | 9/1911 | Lacroix | 312/319.4 |
| 1,039,359 | A | * | 9/1912 | Brown | 211/118 |
| 1,079,241 | A | * | 11/1913 | Hertsgaard | 211/119 |
| 1,681,218 | A | * | 8/1928 | Carlson | 108/110 |
| 1,820,427 | A | * | 8/1931 | Birmann | 187/349 |
| 2,177,678 | A | * | 10/1939 | Uhri, Jr. | 108/106 |
| 2,230,374 | A | * | 2/1941 | Carver | 108/96 |
| 2,556,105 | A | * | 6/1951 | Rhett | 108/106 |
| 2,894,642 | A | * | 7/1959 | Clevett, Jr. et al. | 108/106 |
| 2,903,227 | A | * | 9/1959 | De Kalb Key | 248/200.1 |
| 2,915,275 | A | * | 12/1959 | Korka | 248/327 |
| 3,081,972 | A | * | 3/1963 | Gray | 248/469 |
| 3,146,735 | A | * | 9/1964 | Kesilman et al. | 108/181 |
| 3,160,278 | A | * | 12/1964 | Varkala | 211/74 |
| D201,164 | S | * | 5/1965 | Sylvan | D6/479 |
| 3,221,678 | A | * | 12/1965 | Doherty | 248/230.1 |
| 3,327,310 | A | * | 6/1967 | Bethune et al. | 343/702 |
| 3,347,187 | A | * | 10/1967 | Khoury | 108/152 |
| 3,479,990 | A | * | 11/1969 | Crow | 119/28.5 |
| 3,479,991 | A | * | 11/1969 | Lichtenberger | 119/28.5 |
| 3,595,209 | A | * | 7/1971 | Parker | 119/706 |
| 3,606,023 | A | * | 9/1971 | Edmunds | 211/74 |
| 3,771,466 | A | * | 11/1973 | Ferdinand et al. | 108/109 |
| 3,977,529 | A | * | 8/1976 | Stroh | 211/187 |
| D243,738 | S | | 3/1977 | Johnson | |
| 4,061,092 | A | * | 12/1977 | Jacobsen et al. | 108/149 |
| 4,231,298 | A | * | 11/1980 | Pollack | 108/64 |
| D270,977 | S | * | 10/1983 | Kneale, III | D6/514 |
| 4,589,351 | A | * | 5/1986 | Love | 108/164 |
| 4,709,640 | A | * | 12/1987 | Jouanin | 108/91 |

(Continued)

OTHER PUBLICATIONS

Found on the internet at: http://www.cablewinesystems.com. on May 16, 2014, 4 pages.

*Primary Examiner* — Joshua J Michener
*Assistant Examiner* — Devin Barnett
(74) *Attorney, Agent, or Firm* — Richard L. Miller

(57) ABSTRACT

A modular rack system suspends wine bottles height adjustably from between a ceiling and a floor. The modular rack system includes a plurality of cables and a plurality of support blocks. The plurality of cables extend tautly from the ceiling to the floor. The plurality of support blocks height adjustably engage the plurality of cables and suspend the wine bottles height adjustably.

82 Claims, 11 Drawing Sheets

(56) References Cited

U.S. PATENT DOCUMENTS

| | | | | | |
|---|---|---|---|---|---|
| 4,736,855 | A * | 4/1988 | Arakawa | 211/94.01 |
| 4,819,817 | A * | 4/1989 | Mar | 211/205 |
| 4,923,202 | A * | 5/1990 | Breveglieri et al. | 280/47.35 |
| 4,998,631 | A * | 3/1991 | Fridjhon | 211/74 |
| 5,065,873 | A * | 11/1991 | Tseng | 211/187 |
| 5,148,928 | A * | 9/1992 | Arnold | 211/187 |
| 5,176,266 | A * | 1/1993 | Gillet | 211/90.04 |
| 5,458,243 | A * | 10/1995 | McBride | 206/503 |
| 5,558,501 | A * | 9/1996 | Wang et al. | 416/244 R |
| 5,622,415 | A * | 4/1997 | Felsenthal et al. | 312/265.4 |
| 5,624,169 | A * | 4/1997 | Bishop, Jr. | 312/319.4 |
| 5,715,954 | A * | 2/1998 | Zaremba | 211/107 |
| 5,924,469 | A * | 7/1999 | Whittemore | 160/368.1 |
| 6,290,074 | B1 * | 9/2001 | Syvuk et al. | 211/74 |
| 6,311,626 | B1 * | 11/2001 | Roberts | 108/42 |
| 6,443,319 | B1 * | 9/2002 | Sander | 211/187 |
| 6,688,238 | B1 * | 2/2004 | Alexiou | 108/42 |
| 6,763,956 | B2 * | 7/2004 | Woods | 211/74 |
| 6,918,497 | B2 * | 7/2005 | Davis | 211/183 |
| 6,935,600 | B1 * | 8/2005 | Barrepski | 248/317 |
| 6,991,117 | B2 | 1/2006 | McCain | |
| 7,624,479 | B1 * | 12/2009 | Lin | 24/135 N |
| 7,673,409 | B2 * | 3/2010 | Pitcher et al. | 40/617 |
| 7,882,967 | B2 * | 2/2011 | Hynes | 211/75 |
| 7,959,019 | B2 * | 6/2011 | Jette | 211/117 |
| 8,079,313 | B2 * | 12/2011 | Sparkowski | 108/110 |
| 8,167,152 | B1 * | 5/2012 | Gatti et al. | 211/187 |
| 8,226,184 | B2 * | 7/2012 | Kang et al. | 312/408 |
| 8,286,564 | B2 * | 10/2012 | Karl et al. | 108/107 |
| 2002/0066708 | A1 * | 6/2002 | Gerard | 211/74 |
| 2004/0104187 | A1 * | 6/2004 | McCain | 211/75 |
| 2005/0199160 | A1 * | 9/2005 | Ching-Po | 108/107 |
| 2008/0272252 | A1 * | 11/2008 | Conde | 248/146 |
| 2009/0120886 | A1 * | 5/2009 | Weiss et al. | 211/74 |
| 2009/0184226 | A1 * | 7/2009 | Clark et al. | 248/340 |
| 2011/0036791 | A1 * | 2/2011 | Huang | 211/74 |
| 2013/0062300 | A1 * | 3/2013 | Drake | 211/183 |
| 2013/0181103 | A1 * | 7/2013 | Jette | 248/219.4 |
| 2013/0233814 | A1 * | 9/2013 | Gupta | 211/74 |
| 2013/0334155 | A1 * | 12/2013 | Kasza et al. | 211/75 |
| 2014/0196635 | A1 * | 7/2014 | Griggs, Jr. | 108/144.11 |
| 2014/0284289 | A1 * | 9/2014 | Perez | 211/49.1 |

* cited by examiner 54
40(58)

40(58)
54
72
60
64
64
54

40(58)
54
70
68
72
66
76
74
60
62
64
74
76
54
66

40(58)
54
74
76
66

66
54
40(58)
76
62
64
64
76
66
54

54
40(58)
64
62
60
54

MODULAR CABLE WINE RACK SYSTEM

BACKGROUND OF THE INVENTION

1. Field of the Invention

The present invention relates to a wine rack, and more particularly, a modular cable wine rack system.

2. Description of the Prior Art

Numerous innovations for wine racks have been provided in the prior art that will be described. Even though these innovations may be suitable for the specific individual purposes to which they address, however, they differ from the present invention.

A FIRST EXAMPLE, U.S. Pat. No. 3,606,023, Published/Issued on Sep. 20, 1971, to Edmunds teaches a sectional knock down rack that is assemblable without any tools. The individual sections are amenable to vertical stacking and to horizontal joining.

A SECOND EXAMPLE, U.S. Pat. No. 4,998,631, Published/Issued on Mar. 12, 1991, to Fridjhon teaches a wine rack including a pair of planar support members each defining a plurality of cradle formations for receiving a wine bottle or the like, and one or more brace elements that are adapted collapsibly to secure the support members to one another in spaced relationship, with cradle formations aligning with one another so that in use these are capable of supporting a wine bottle in a horizontal or tilted attitude.

A THIRD EXAMPLE, U.S. Pat. No. 5,624,169, Published/Issued on Apr. 29, 1997, to Bishop, Jr. teaches a rack for storing a plurality of recording media in a stacked configuration. The rack includes a platform upon which a stack of recording media can be positioned. The platform is movably mounted to a support assembly for supporting the platform relative to a surface. A biasing assembly urges the platform towards an upper portion of the support assembly and permits an insertion of additional recording media into a portion of the stack positioned upon the platform.

A FOURTH EXAMPLE, U.S. Pat. No. 6,763,956, Published/Issued on Jul. 20, 2004, to Woods teaches a wine rack. Large versions of the wine rack are adapted to be installed against a wall of a room or as a free standing wall separated from the walls of a room. The wine rack is a monolithic flat rigid sheet to which has uniformly mounted in rows through holes therein a like number of wine bottle support rods that project perpendicularly and parallel to each other from one or both faces of the sheet so that two wine bottles of varying sidewall diameter is storable on three of the rods without their side-walls touching and whose essential elements are fabricatable offsite by forming uniform rows of holes in a monolithic sheet of stainless steel. Fitting in the holes are machine bolts whose threaded shank ends project beyond a face of the steel sheet. Bonding the heads of the bolts to the opposite face of the steel sheet so that their threaded ends project axially perpendicularly, rigidly, and parallel to each other. Forming a female threaded cavity in one end of a plurality of wine bottle support rods. The thus-fabricated structural parts of the wine rack are then transported to the installation site where the rods are coupled to the projecting ends of the bolts. A plurality of the thus-fabricated wine rack are mounted side-by-side vertically on a wall of a room at the installation site or one of them is installable as a free standing version that is stabilizing from bending or swaying at its base. A free standing version with wine bottle support rods projecting from both faces thereof are similarly producable using short lengths of threaded steel rods which, when inserted in the holes in the steel sheet, its ends project a short distance beyond each face of the steel sheet so that the internally female threaded ends wine bottle support rods are mountable on both ends thereof.

A FIFTH EXAMPLE, U.S. Pat. No. 6,991,117, Published/Issued on Jan. 31, 2006, to McCain teaches a wine rack for mounting on a wall or other surface. The wine rack includes at least a first and second pair of support members. In one embodiment, the first pair of support members may support at least a first and a second wine bottle in a substantially parallel relation to the wall. The second bottle is positionable proximate the wall. The label of the first wine bottle is visible to a person standing in front of the wine rack. The second pair of support members may support at least a third and a fourth wine bottle in a substantially parallel relation to the wall. The fourth bottle is positionable proximate the wall. The label of the third wine bottle is visible to the person standing in front of the wine rack. In one example, a pair of frame elements are attachable to the support members in order to mount the support members to the wall.

A SIXTH EXAMPLE, U.S. Pat. No. 7,882,967, Published/Issued on Feb. 8, 2011, to Hynes teaches a modular wine rack system stores wine with the label facing the user. The system has at least two identical rods with indentations sized to hold a wine bottle. The rods are attached to a wall or frame to extend therefrom. The rods may be spaced apart so that the bottles are stored angled downwardly, with the body supported on one rod and the neck supported on the other.

A SEVENTH EXAMPLE, U.S. Pat. No. 7,959,019, Published/Issued on Jun. 14, 2011, to Jette teaches a suspended cable support system. The suspended cable support system includes a plurality of suspension rods, and at least one cable tray. Each cable tray includes a pair of stringer elements. Each stringer element is configured for connection to at least one suspension rod. A channel section depends from the pair of stringer elements, defines a passageway for supporting runs of cable thereon, and includes a plurality of riser portions connected to the pair of stringer elements.

AN EIGHTH EXAMPLE, U.S. Pat. No. D243,738, Published/Issued on Mar. 22, 1977, to Johnson teaches the ornamental design for a wine rack.

A NINTH EXAMPLE, U.S. Pat. No. 20130062300, Published/Issued on Mar. 14, 2013, to Drake teaches a bracket or support member including a body, at least one arm or hook extending away from the body that is insertable through an aperture in a support apparatus. The at least one arm or hook includes an end portion that is adapted to be received into a recess on a rear surface of the support apparatus. A support system is also taught, which utilizes the bracket or support member in combination with an apertured panel. Further taught are bracket systems and brackets.

A TENTH EXAMPLE, U.S. Patent Office Document No. 20130233814, Published/Issued on Sep. 12, 2013, to Gupta teaches a modular system for at least one of displaying and storing at least one article. The modular system includes at least a pair of elongated support brackets, at least one elongated cross member, and apparatus for positioning each of the at least one elongated cross member and the at least pair of elongated support brackets in a generally horizontal plane during use of the modular system. The at least a pair of elongated support brackets are disposed in a spaced-apart parallel relationship with each other. The at least one elongated cross member is sized to at least span a distance between the at least pair of elongated support brackets. Additionally, the at least one elongated cross member may at least rest on a top edge of each of the at least the pair of elongated support brackets during use of the modular system.

An ELEVENTH EXAMPLE, Non-patent art, cablewinesystems.com, by Cable Wine Systems, Inc. The Cable Wine System includes tension cables made from stainless steel aircraft cable, top and bottom tension sets, and connecting clamps made of solid brass with brushed nickel and chromed finishes. In addition to the aesthetic appeal of its' individual pieces, the double cable cradling of each individual wine bottle makes them look as though they are floating in midair. Additional features include angled bottle displays, accent lighting, and floating shelves that are incorporatable at any point throughout the system's design.

It is apparent now that numerous innovations for wine racks have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a modular cable wine rack system that avoids the disadvantages of the prior art.

ANOTHER OBJECT of the present invention is to provide a modular cable wine rack system that is simple and inexpensive to manufacture.

STILL ANOTHER OBJECT of the present invention is to provide a modular cable wine rack system that is simple to use.

BRIEFLY STATED, STILL YET ANOTHER OBJECT of the present invention is to provide a modular rack system suspends wine bottles height adjustably from between a ceiling and a floor. The modular rack system includes a plurality of cables and a plurality of support blocks. The plurality of cables extend tautly from the ceiling to the floor. The plurality of support blocks height adjustably engage the plurality of cables and suspend the wine bottles height adjustably.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

Figure 1:
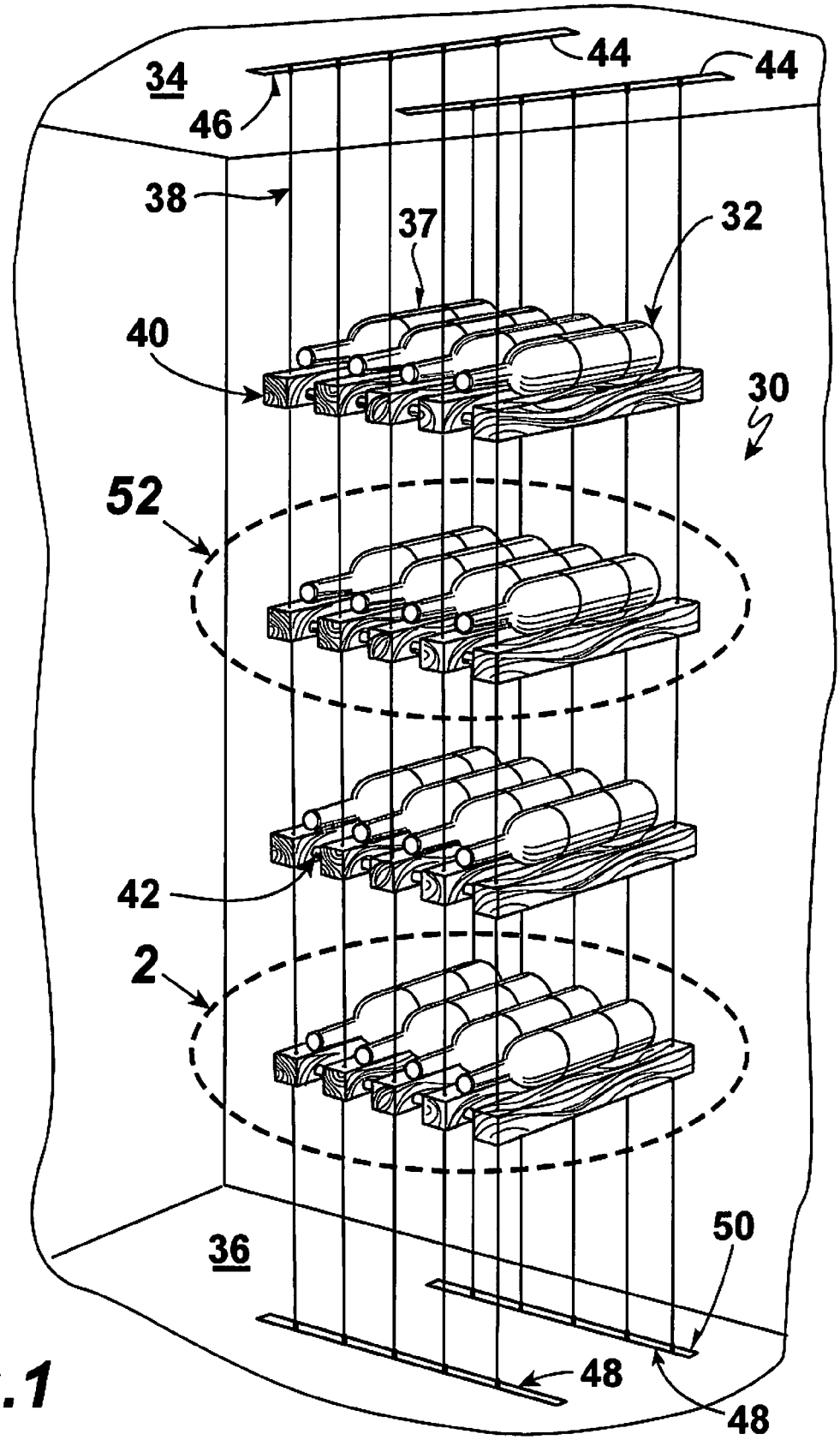
FIG. 1 is a diagrammatic perspective view of an embodiment of a MODULAR CABLE WINE RACK SYSTEM which has been fabricated to hold sixteen bottles of wine.
Figure 2:
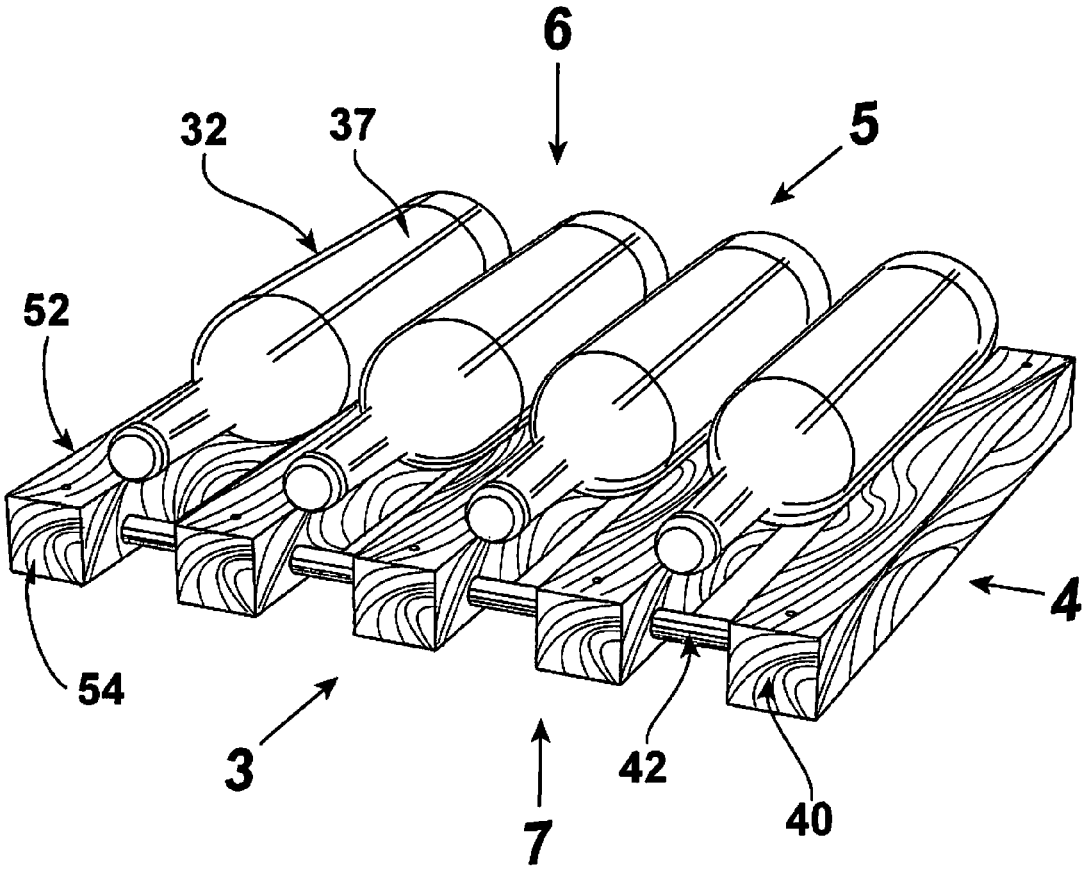
FIG. 2 is an enlarged view showing greater details of the area enclosed in the dotted curve indicated by arrow 2 in FIG. 1.
Figure 3:
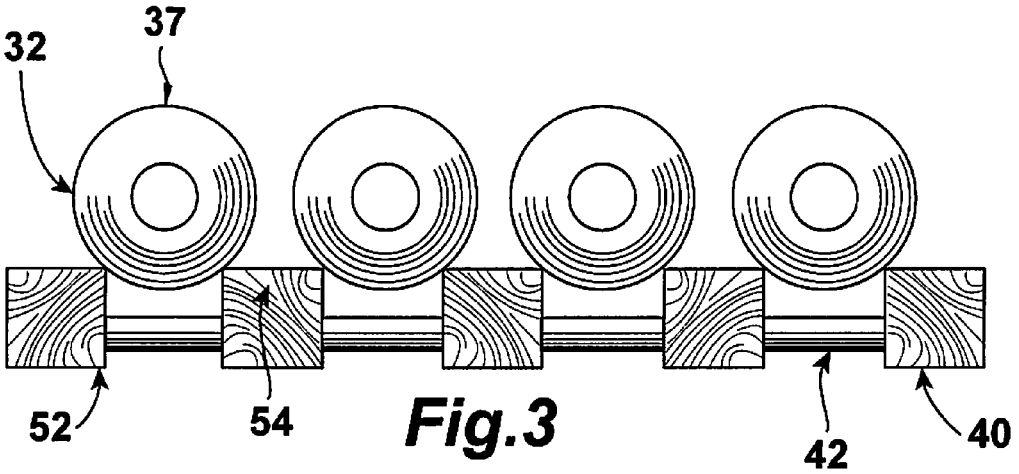
FIG. 3 is a front elevational view thereof taken in the direction of arrow 3 in FIG. 2.
Figure 4:
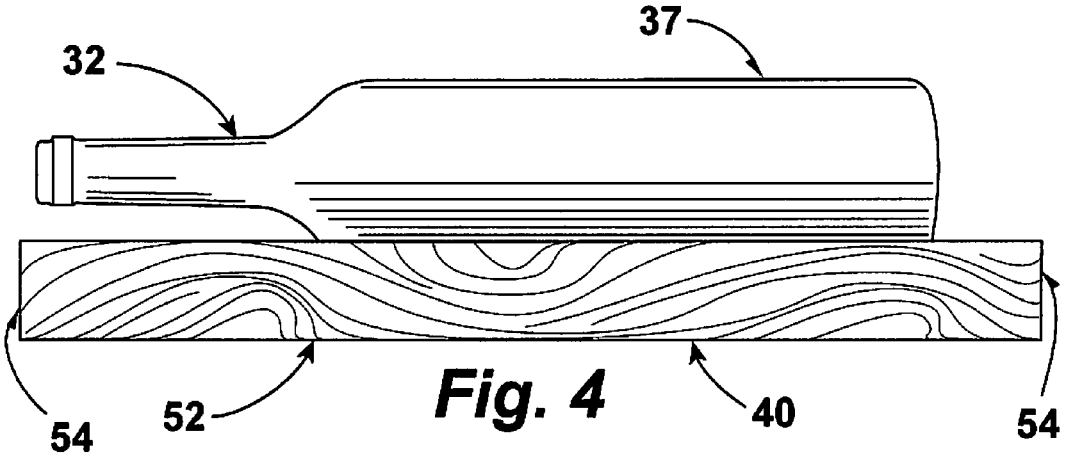
FIG. 4 is a left side elevational view thereof taken in the direction of arrow 4 in FIG. 2.
Figure 5:
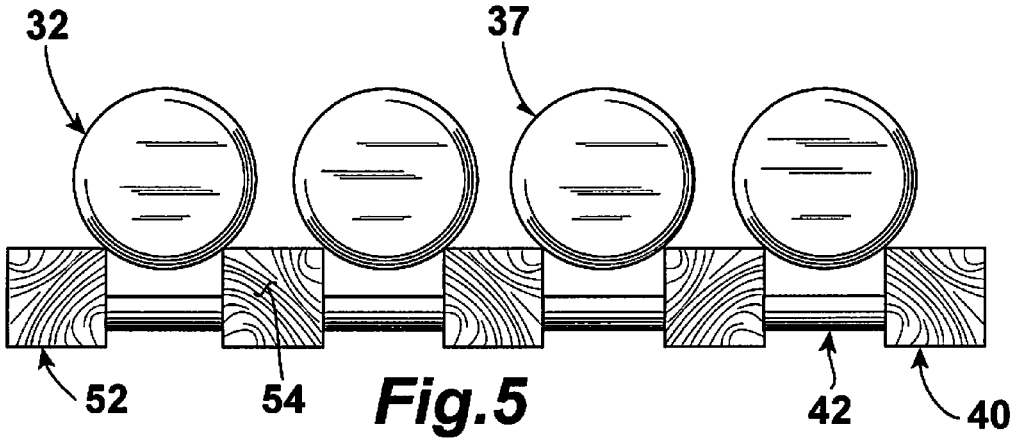
FIG. 5 is a rear elevational view thereof taken in the direction of arrow 5 in FIG. 2.
Figure 6:
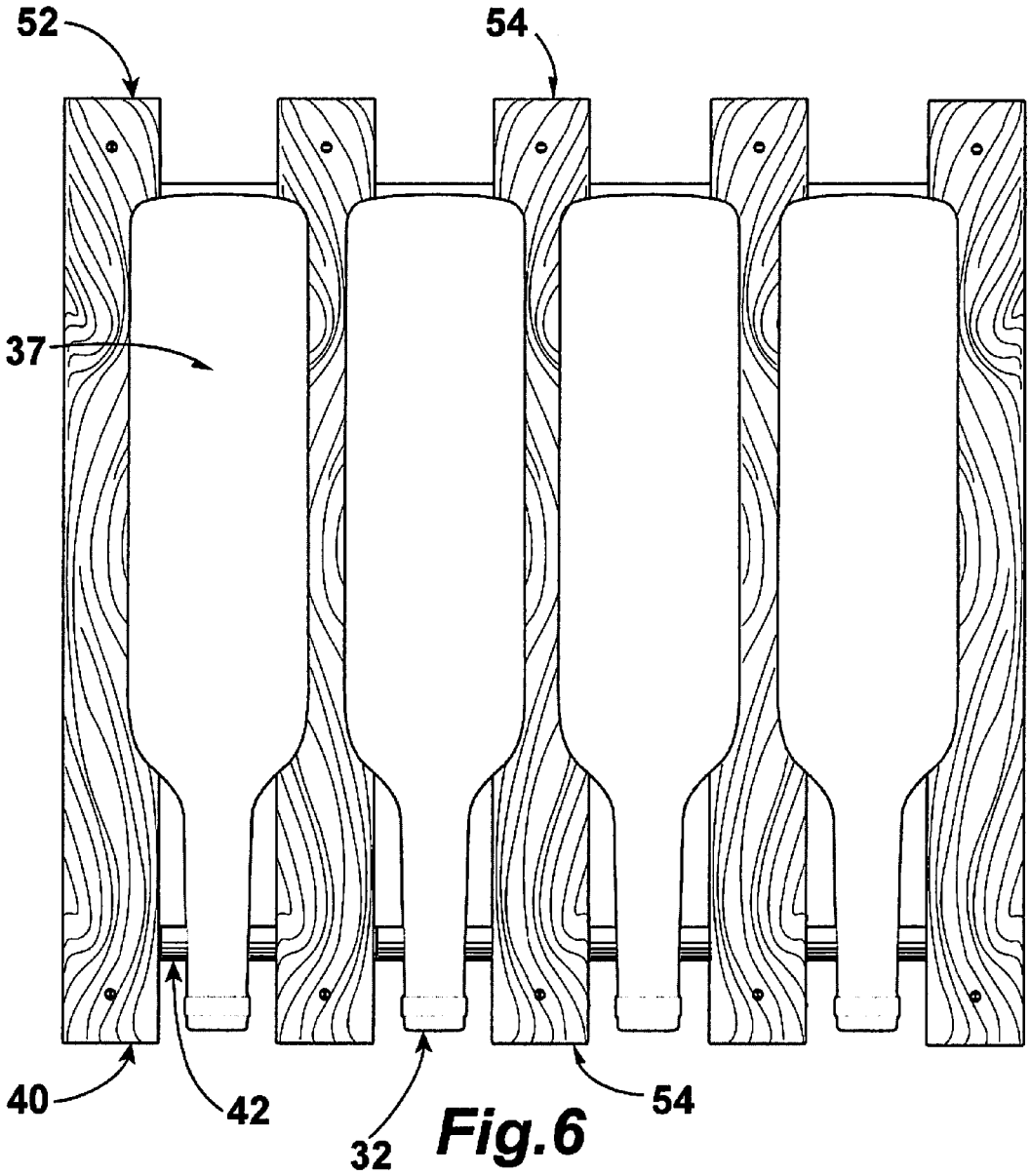
FIG. 6 is a top plan view thereof taken in the direction of arrow 6 in FIG. 2.
Figure 7:
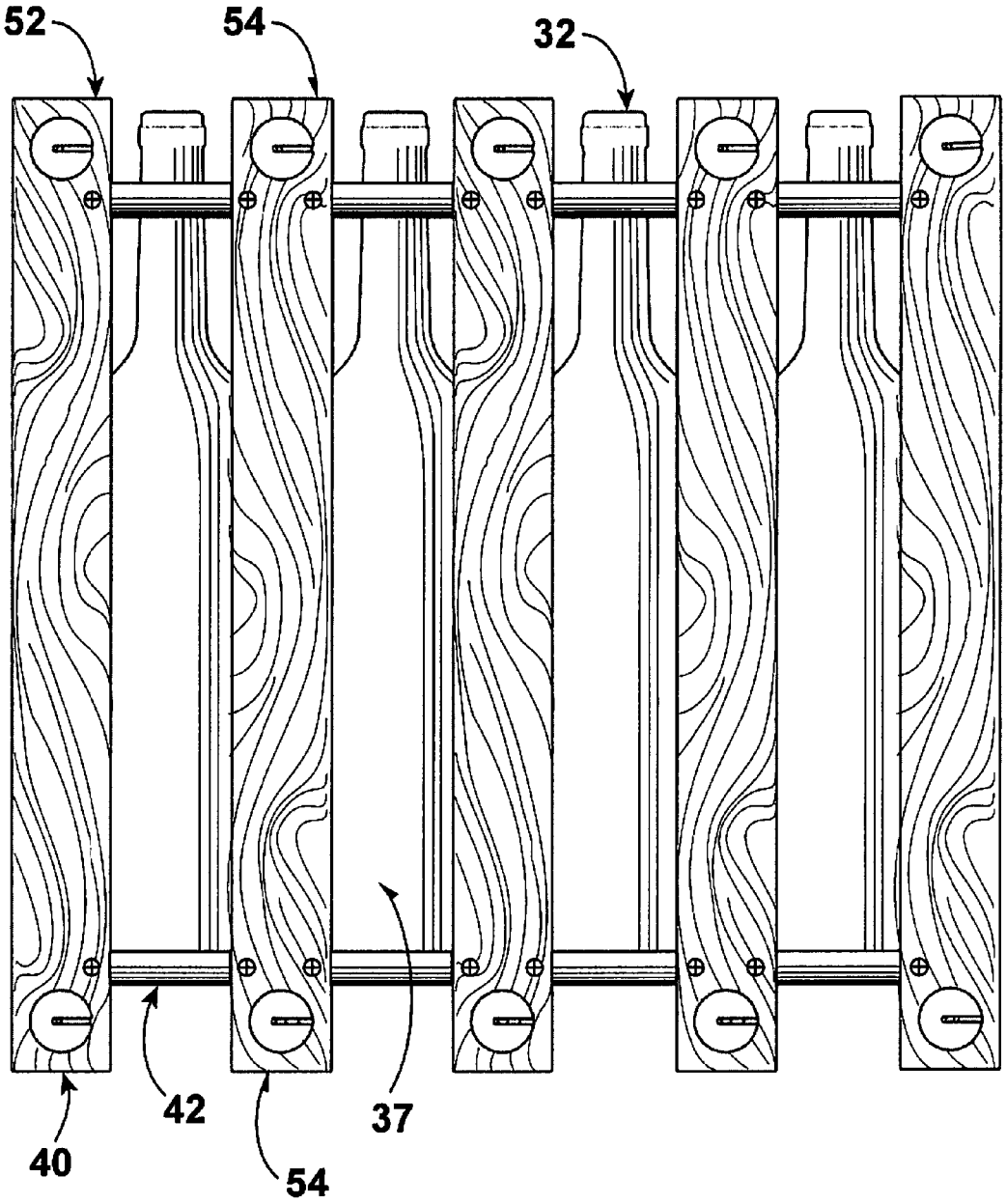
FIG. 7 is a bottom plan view thereof taken in the direction of arrow 7 in FIG. 2.

It is to be further understood that although the present drawings illustrate a MODULAR CABLE WINE RACK SYSTEM for holding just sixteen bottles a rack for holding substantial any number of bottles may be constructed and that the number of such bottles is limited only by the height of the ceiling and the width of the room where said wine rack is to be fabricated.

A MARSHALING OF REFERENCE NUMERALS UTILIZED IN THE DRAWING

30 modular rack system of embodiments of the present invention for suspending wine bottles 32 height adjustably from between ceiling 34 and floor 36
32 wine bottles
34 ceiling
36 floor
37 body of wine bottle 32
38 plurality of cables for extending tautly from ceiling 34 to floor 36
40 plurality of support blocks for suspending wine bottles 32 height adjustably
42 plurality of distance/stability tubes
44 ceiling anchors for attaching upper ends 46 of plurality of cables 38 to ceiling 34
46 upper ends of plurality of cables 38
48 floor anchors for attaching lower ends 50 of plurality of cables 38 to floor 36
50 lower ends of plurality of cables 38

52 module for holding up to one less wine bottle 32 than number of support blocks 40

54 end faces of plurality of support blocks 40 of each module 52, respectively

56 at least one intermediate block OF plurality of support blocks 40

58 at least two end blocks of plurality of support blocks 40

60 top face of each end block 58 of plurality of support blocks 40 of each module 52, respectively

62 bottom face of each end block 58 of plurality of support blocks 40 of each module 52, respectively

64 pair of side faces of each end block 58 of plurality of support blocks 40 of each module 52, respectively

66 pair of through bores 66 of each end block 58 of plurality of support blocks 40 of each module 52

67 pair of cable connectors of each end block 58 of plurality of support blocks 40 of each module 52

68 widest portion of through bore 66 of each end block 58 of plurality of support blocks 40 of each module 52

70 narrower intermediate portion of through bore 66 of each end block 58 of plurality of support blocks 40 of each module 52

72 narrowest portion of through bore 66 of each end block 58 of plurality of support blocks 40 of each module 52

74 pair of blind bores of each end block 58 of plurality of support blocks 40 of each module 52

76 threaded blind bores of each end block 58 of plurality of support blocks 40 of each module 52

78 set screws of each end block 58 of plurality of support blocks 40 of each module 52

80 pair of ends of each distance/stability tube of plurality of distance/stability tubes 42

82 pair of threaded bores of each distance/stability tube of plurality of distance/stability tubes 42

83 axis of each cable connector of pair of cable connectors 67 of plurality of support blocks 40

84 base portion of each cable connector of pair of cable connectors of plurality of support blocks 40

86 upper face of base portion 84 of each cable connector of pair of cable connectors 67 of plurality of support blocks 40

88 periphery of base portion 84 of each cable connector of pair of cable connectors 67 of plurality of support blocks 40

90 lower face of base portion 84 of each cable connector of pair of cable connectors 67 of plurality of support blocks 40

92 stub portion of each cable connector of pair of cable connectors 67 of plurality of support blocks 40

94 upper face of stub portion 92 of each cable connector of pair of cable connectors 67 of plurality of support blocks 40

96 periphery of stub portion 92 of each cable connector of pair of cable connectors 67 of plurality of support blocks 40

98 blind slot of each cable connector of pair of cable connectors 67 of plurality of support blocks 40

100 threaded blind bore of each cable connector of pair of cable connectors 67 of plurality of support blocks 40

102 set screw of each cable connector of pair of cable connectors 67 of plurality of support blocks 40

DETAILED DESCRIPTION OF THE PREFERRED EMBODIMENT

Referring now to the figures, in which like numerals indicate like parts, and particularly to FIG. 1, the modular rack system of the embodiments of the present invention is shown generally at 30 for suspending wine bottles 32 height adjustably from between a ceiling 34 and a floor 36, wherein each wine bottle 32 has a body 37 with a diameter.

The modular rack system 30 comprises a plurality of cables 38 and a plurality of support blocks 40. The plurality of cables 38 are for extending tautly from the ceiling 34 to the floor 36. The plurality of support blocks 40 height adjustably engage the plurality of cables 38, and are for suspending the wine bottles 32 height adjustably.

The support blocks 40 are spaced-apart from each other by a distance.

The modular rack system 30 further comprises a plurality of distance/stability tubes 42.

The plurality of distance/stability tubes 42 extend between adjacent pairs of support blocks 40 and fix the distance between the adjacent pairs of support blocks 40, while adding stability to the adjacent pairs of support blocks 40.

The modular rack system 30 further comprises ceiling anchors 44.

The ceiling anchors 44 engage upper ends 46 of the plurality of cables 38 for attaching the plurality of cables 38 to the ceiling 34.

The modular rack system 30 further comprises floor anchors 48.

The floor anchors 48 engage lower ends 50 of the plurality of cables 38 for attaching the plurality of cables 38 to the floor 36.

The plurality of cables 38 are made of steel.

The plurality of support blocks 40 are made of wood.

At least one pair of the plurality of support blocks 40 together with at least one pair of the plurality of distance/stability tubes 42 form a module 52.

Each module 52 is disposed at a specific elevation along the plurality of cables 38, and is for holding up to one less wine bottle 32 than the number of support blocks 40.

The specific configuration of the module 52 can best be seen in FIGS. 2-7, and as such, will be discussed with reference thereto.

Each module 52 includes the at least one pair of the plurality of support blocks 40 and the at least one pair of the plurality of distance/stability tubes 42.

The plurality of support blocks 40 of each module 52 are spaced-apart from each other, are horizontally aligned with each other, are parallel to each other, and have end faces 54, respectively.

The plurality of distance/stability tubes 42 of each module 52 extend between adjacent pairs of support blocks 40, and are disposed adjacent to the end faces 54 of the plurality of support blocks 40 of each module 52, respectively.

Adjacent pairs of support blocks 40 of each module 52 are spaced-apart from each other a distance less than the diameter of the wine bottle 32 for cradling the wine bottle 32 therebetween.

The plurality of distance/stability tubes 42 of each module 52 are spaced-apart from each other, are horizontally aligned with each other, are parallel to each other, and are disposed perpendicularly to the plurality of support blocks 40 of an associated module 52.

The specific configuration of each support block 40 can best be seen in FIGS. 8-15, and as such, will be discussed with reference thereto.

The plurality of support blocks 40 of each module 52 include at least one intermediate block 56 (FIG. 8) and at least two end blocks 58 (FIGS. 9-15).

Each end block 58 of the plurality of support blocks 40 of each module 52 is slender, elongated, and rectangular parallelepiped-shaped.

Each intermediate block 56 of the plurality of support blocks 40 of each module 52 is slender, elongated, and rectangular parallelepiped-shaped.

Each end block 58 of the plurality of support blocks 40 of each module 52 has the end faces 54, a top face 60, a bottom face 62, and a pair of side faces 64.

Each end block 58 of the plurality of support blocks 40 of each module 52 further has a pair through bores 66.

The pair of through bores 66 of each end block 58 of the plurality of support blocks 40 of each module 52 receive a pair of cable connectors 67, respectively, and extend from the bottom face 62 of an associated end block 58 of the plurality of support blocks 40 of an associated module 52 to the top face 60 of the associated end block 58 of the plurality of support blocks 40 of the associated module 52, and are disposed near the ends 54 of the associated end block 58 of the plurality of support blocks 40 of the associated module 52, respectively.

Each through bore 66 of each end block 58 of the plurality of support blocks 40 of each module 52 is cylindrical and axially stepped in three coaxial and progressively narrower diameters, as the through bore 66 of an associated end block 58 of the plurality of support blocks 40 of an associated module 52 extends from the bottom face 62 of the associated end block 58 of the plurality of support blocks 40 of the associated module 52 to the top face 60 of the associated end block 58 of the plurality of support blocks 40 of the associated module 52.

Thus, the through bore 66 of each end block 58 of the plurality of support blocks 40 of each module 52 has a widest portion 68, an intermediate portion 70, and a narrowest portion 72.

The widest portion 68 of the through bore 66 of each end block 58 of the plurality of support blocks 40 of each module 52 originates in the bottom face 62 of an associated end block 58 of the plurality of support blocks 40 of an associated module 52.

The narrowest portion 72 of the through bore 66 of each end block 58 of the plurality of support blocks 40 of each module 52 originates in the top face 60 of an associated end block 58 of the plurality of support blocks 40 of an associated module 52.

The intermediate portion 70 of the through bore 66 of each end block 58 of the plurality of support blocks 40 of each module 52 communicatingly connects the widest portion 68 of the through bore 66 of an associated end block 58 of the plurality of support blocks 40 of an associated module 52 to the narrowest portion 72 of the through bore 66 of the associated end block 58 of the plurality of support blocks 40 of the associated module 52.

Each end block 58 of the plurality of support blocks 40 of each module 52 further has a pair of blind bores 74.

The pair of blind bores 74 of each end block 58 of the plurality of support blocks 40 of each module 52 extend into one side face 64 of an associated end block 58 of the plurality of support blocks 40 of an associated module 52, and are disposed just inwardly of the pair of through bores 66 of the associated end block 58 of the plurality of support blocks 40 of the associated module 52, respectively, are further disposed closer to the bottom face 62 of the associated end block 58 of the plurality of support blocks 40 of the associated module 52, and are sized to receive the plurality of distance/stability tubes 42 of the associated module 52.

Each end block 58 of the plurality of support blocks 40 of each module 52 further has a pair of threaded blind bores 76.

The pair of threaded blind bores 76 of each end block 58 of the plurality of support blocks 40 of each module 52 receive a pair of set screws 78, respectively, extend into the bottom face 62 of an associated end block 58 of the plurality of support blocks 40 of an associated module 52, are disposed just inwardly of the pair of through bores 66 of the associated end block 58 of the plurality of support blocks 40 of the associated module 52, respectively, are further disposed closer to the one side face 64 of the associated end block 58 of the plurality of support blocks 40 of the associated module 52, and communicate with the pair of blind bores 74 of the associated end block 58 of the plurality of support blocks 40 of the associated module 52, respectively, so as to allow the pair of set screws 78 of the associated end block 58 of the plurality of support blocks 40 of the associated module 52 to contact and lock the plurality of distance/stability tubes 42 of the associated module 52 into the pair of blind bores 74 of the associated end block 58 of the plurality of support blocks 40 of the associated module 52, respectively.

Figure 8:
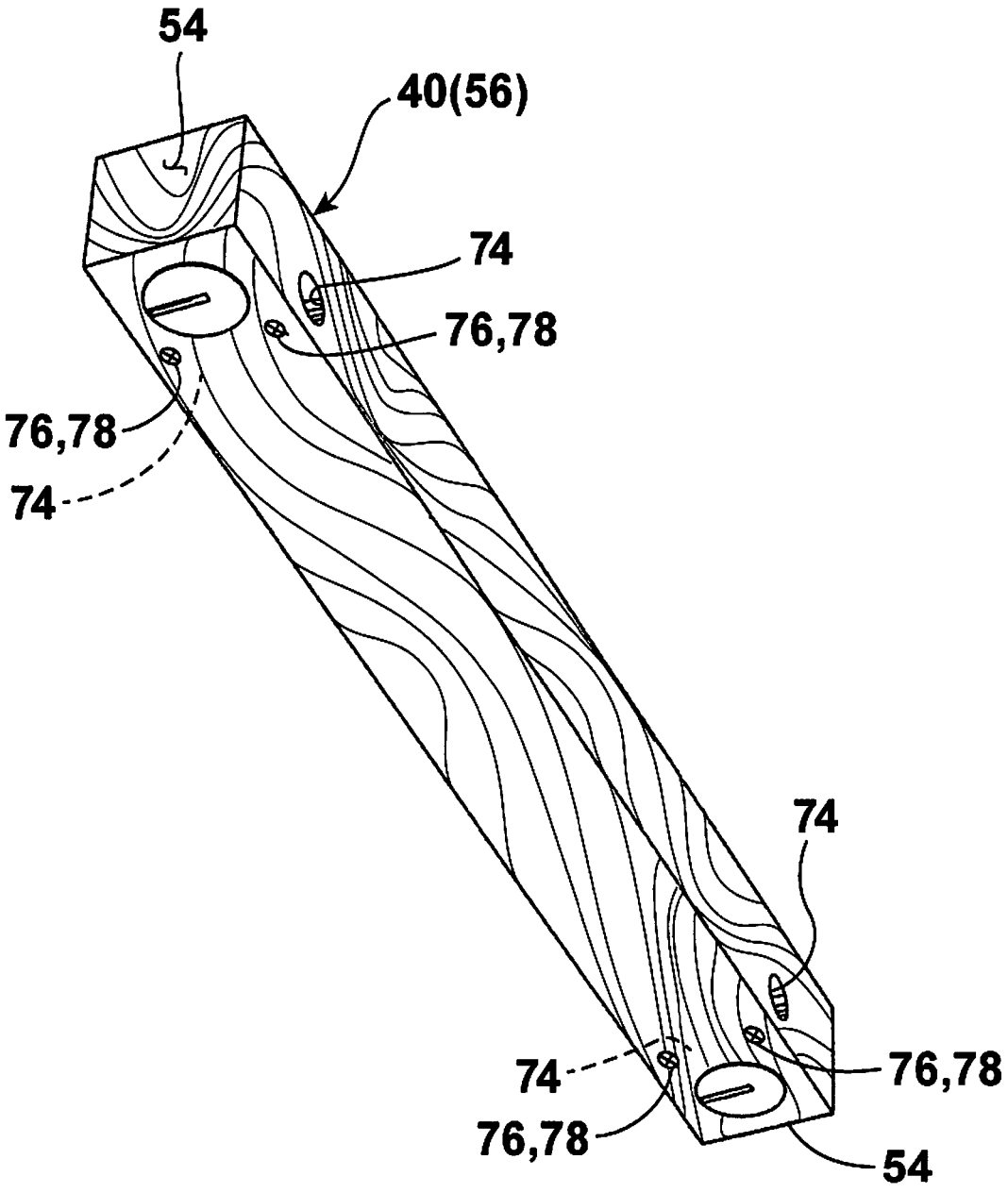
FIG. 8 is diagrammatic perspective view of a center block component.
Figure 9:
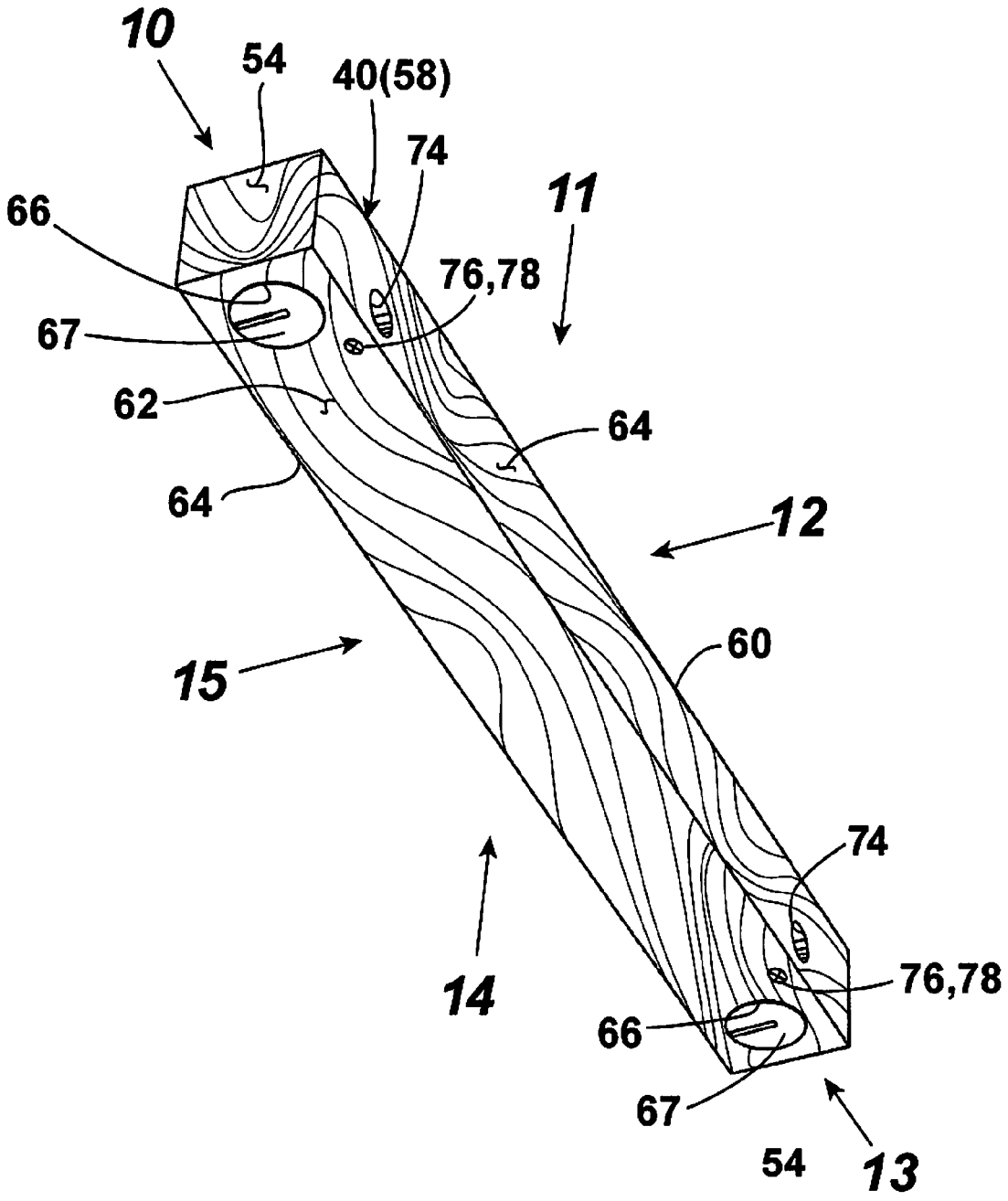
FIG. 9 is diagrammatic perspective view of an end block component.
Figures 10, 11, 12, 13, 14, 15:
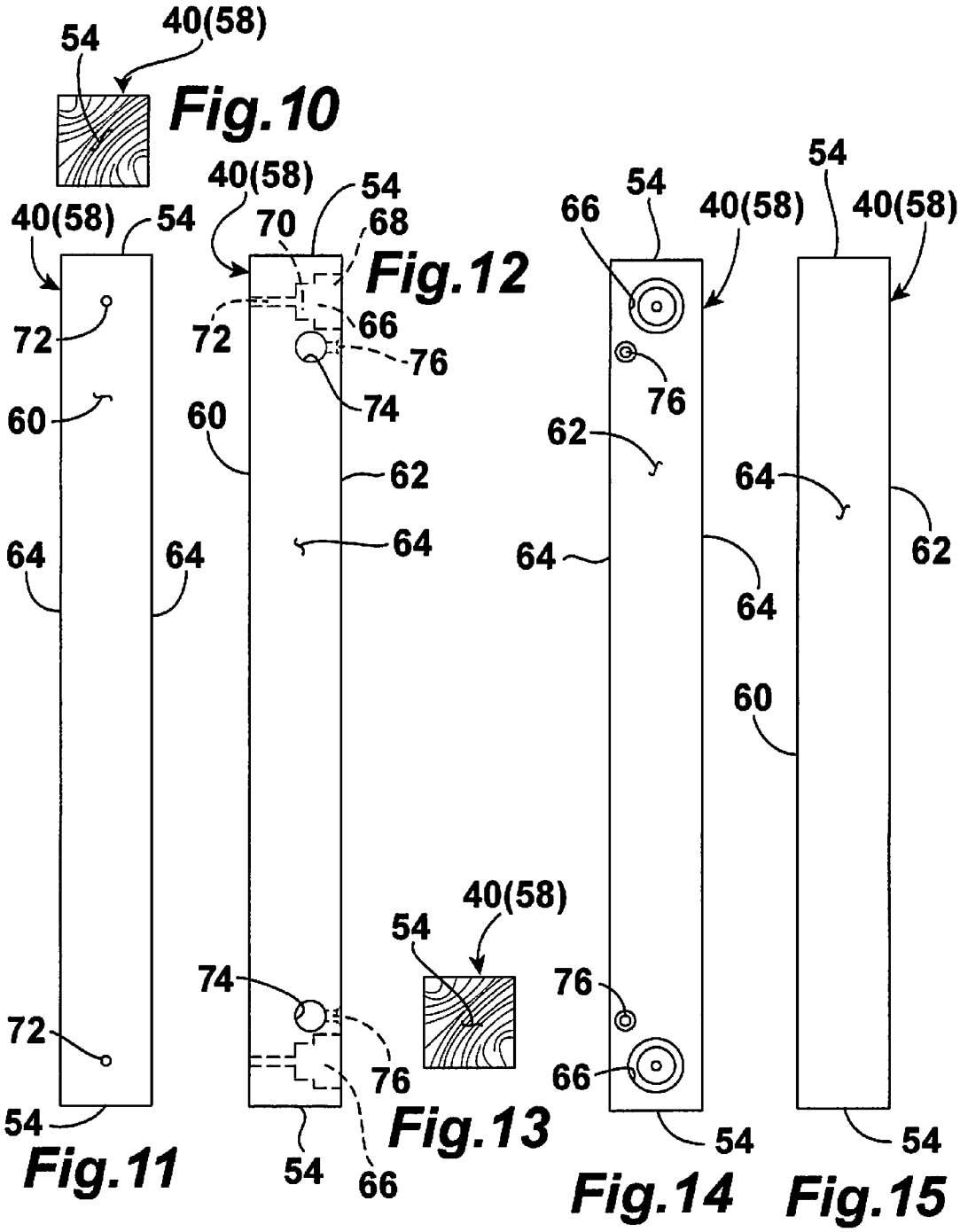
FIG. 10 is a proximal end elevational thereof, taken in the direction of arrow 10 in FIG. 9.
FIG. 11 is a top plan view thereof taken in the direction of arrow 11 in FIG. 9.
FIG. 12 is a left side view thereof taken in the direction of arrow 12 in FIG. 9.
FIG. 13 is a distal end elevational thereof, taken in the direction of arrow 13 in FIG. 9.
FIG. 14 is a bottom plan view thereof taken in the direction of arrow 14 in FIG. 9.
FIG. 15 is a right side view thereof taken in the direction of arrow 15 in FIG. 9.
Figure 16:
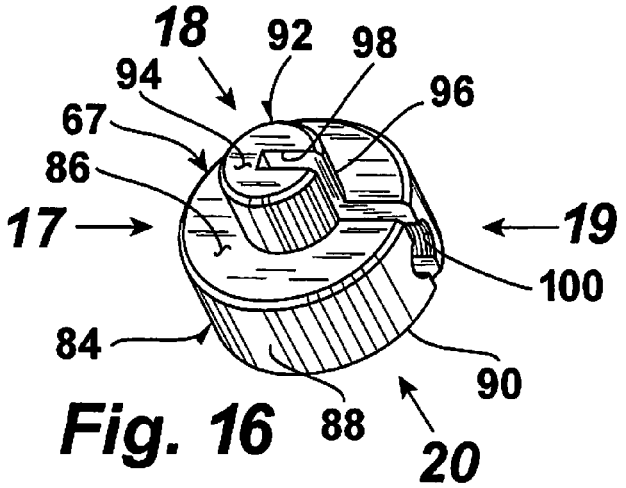
FIG. 16 is a diagrammatic perspective of a cable connecting component.
Figure 17:
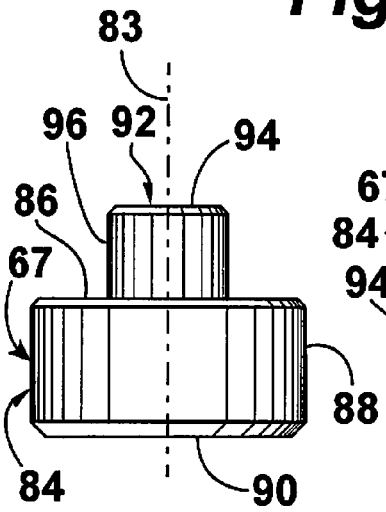
FIG. 17 is a rear elevational view thereof taken in the direction of arrow 17 in FIG. 16.
Figure 18:
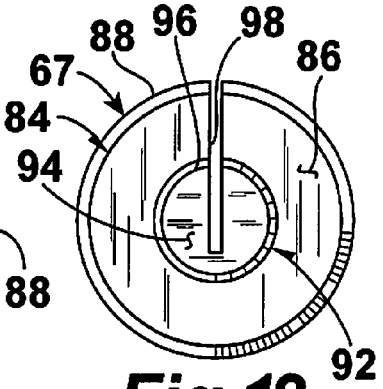
FIG. 18 is a top plan view thereof taken in the direction of arrow 18 in FIG. 16.
Figure 19:
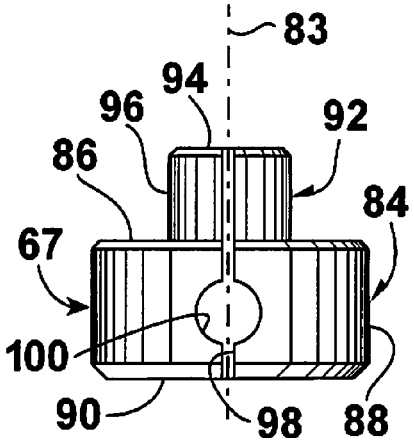
FIG. 19 is a front elevational view thereof taken in the direction of arrow 19 in FIG. 16.
Figure 20:
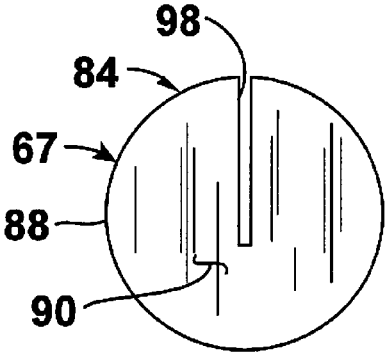
FIG. 20 is a bottom plan view thereof taken in the direction of arrow 20 in FIG. 16.
Figure 21:
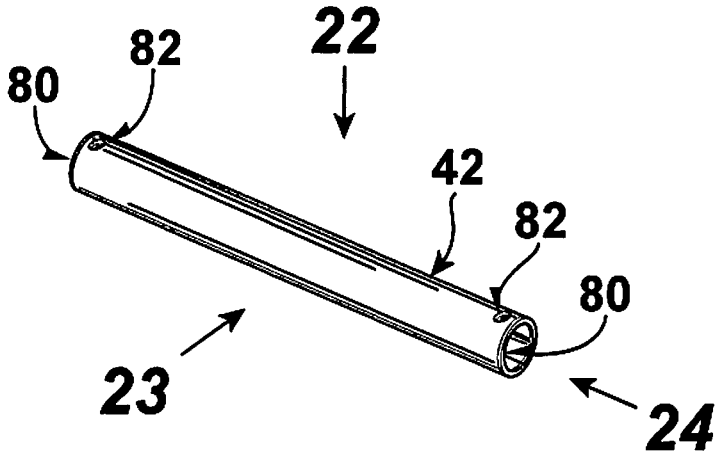
FIG. 21 is a diagrammatic perspective of a block spacer connecting component.
Figure 22:
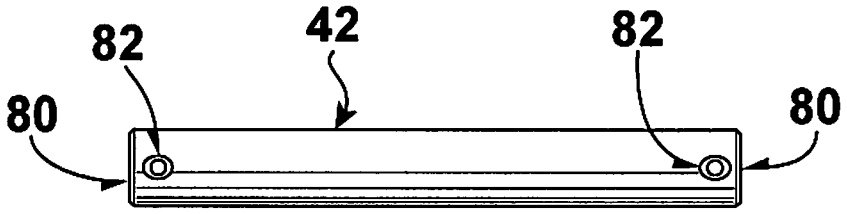
FIG. 22 is a top plan view thereof taken in the direction of arrow 22 in FIG. 21.
Figure 23:
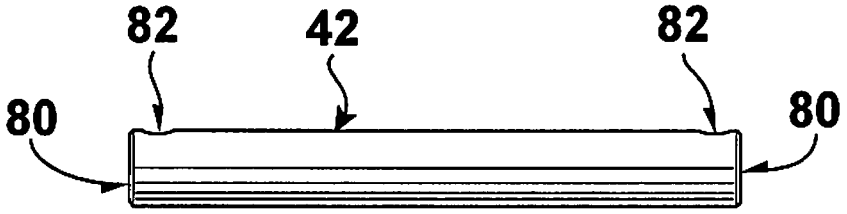
FIG. 23 is a side view thereof taken in the direction of arrow 23 in FIG. 21.
Figure 24:
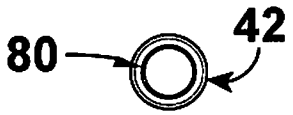
FIG. 24 is an end elevational thereof, taken in the direction of arrow 24 in FIG. 21.

As shown in FIG. 8, the at least one intermediate block 56 of the plurality of support blocks 40 of each module 52 is similar to each end block 58, except:

The pair of blind bores 74 of each intermediate block 56 of the plurality of support blocks 40 of each module 52 extend into both side faces 64 of an associated intermediate block 56 of the plurality of support blocks 40 of an associated module 52; and The pair of threaded blind bores 76 of each intermediate block 56 of the plurality of support blocks 40 of each module 52 extend into the bottom face 62 of an associated intermediate block 58 of the plurality of support blocks 40 of an associated module 52, and are further disposed close to the pair of side faces 64 of the associated intermediate block 58 of the plurality of support blocks 40 of the associated module 52.

The specific configuration of each distance/stability tube 42 of each module 52 can best be seen in FIGS. 21-24, and as such, will be discussed with reference thereto.

Each distance/stability tube 42 is tubular, hollow, straight, slender, elongated, and has a pair of ends 80.

Each distance/stability tube 42 further has a pair of threaded bores 82.

The pair of threaded bores 82 of each distance/stability tube 42 are disposed in close proximity to the pair of ends 80 of an associated distance/stability tube 42, respectively, and are axially aligned.

The specific configuration of each cable connector 67 can best be seen in FIGS. 16-20, and as such, will be discussed with reference thereto.

Each cable connector 67 has an axis 83 and a base portion 84.

The base portion 84 of each cable connector 67 is cylindrically shaped, and has an upper face 86, a periphery 88, and a lower face 90.

Each cable connector 67 further has a stub portion 92.

The stub portion 92 of each cable connector 67 is cylindrically shaped, and has an upper face 94, and a periphery 96.

The stub portion 92 of each cable connector 67 extends coaxially and upwardly from the base portion 84 of an associated cable connector 67.

Each cable connector 67 further has a blind slot 98.

The blind slot 98 of each cable connector 67 extends radially through an associated cable connector 67, from the lower face 90 of the base portion 84 of the associated cable connector 67 to the upper face 94 of the stub portion 92 of the associated cable connector 67, and further extends radially inwardly from the periphery 88 of the base portion 84 of the associated cable connector 67 and from the periphery 96 of the stub portion 92 of the associated cable connector 67 to just past the axis 83 of the associated cable connector 67.

Each cable connector 67 further has a threaded blind bore 100.

The threaded blind bore 100 of each cable connector 67 extends radially inwardly from the periphery 88 of the base portion 84 of the associated cable connector 67 to, and communicates with, the blind slot 98 of the associated cable connector 67.

Figure 25:
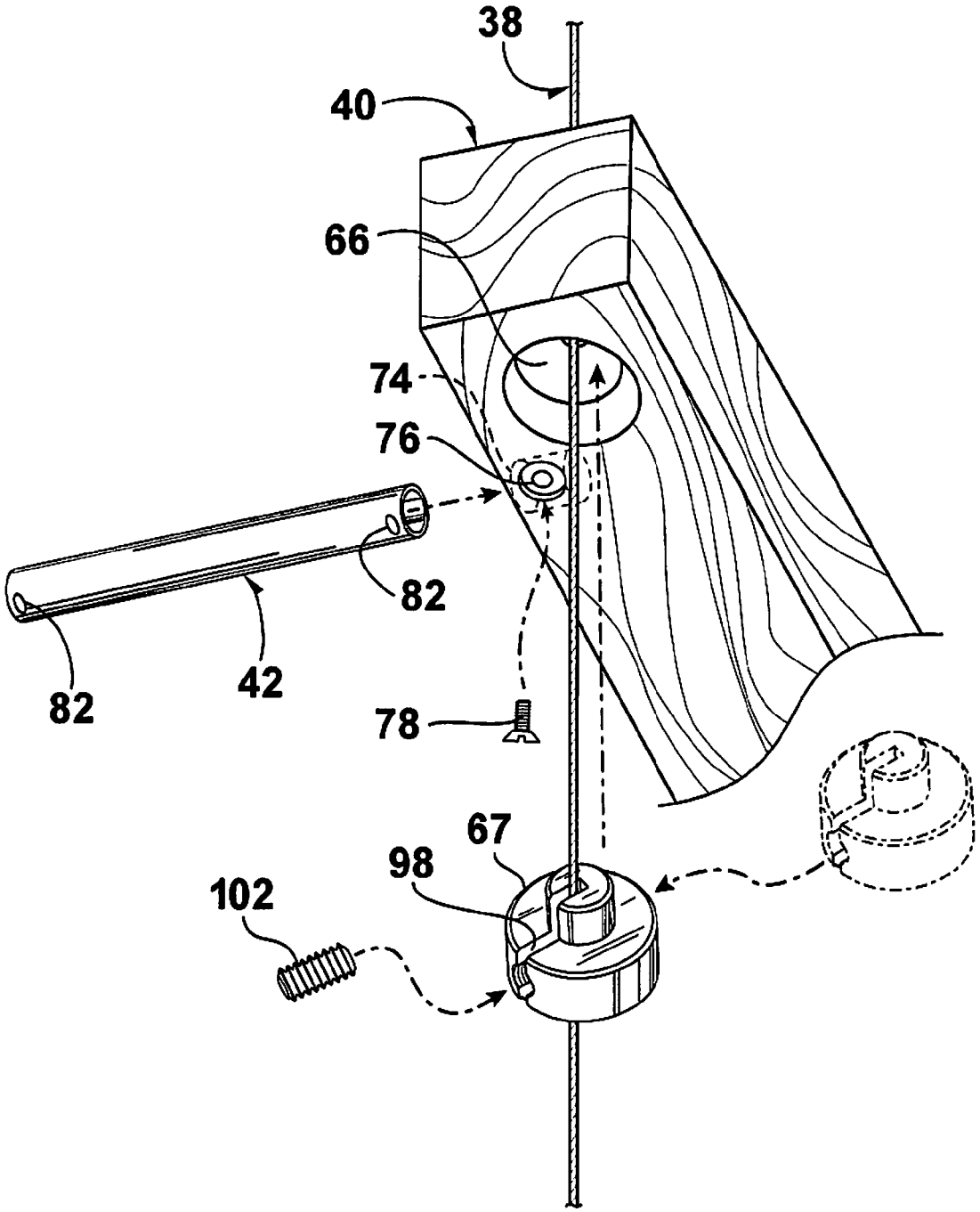
FIG. 25 is diagrammatic assembly view with parts broken away illustrating how the various components are assembled together and accordingly cooperate with each other so that a module of the MODULAR CABLE WINE RACK SYSTEM may be appropriately fabricated.

As shown in FIG. 25, each cable connector 67 sits in an associated through bore 66 of the plurality of support blocks 40, with an associated cable 38 being captured in the blind slot 98 of the associated cable connector 67, and being maintained thereat, by a set screw 102 threadably engaging in the threaded blind bore 100 of the associated cable connector 67 and up against the associated cable 38.

Further, each distance/stability tube 42 sits in an associated blind bore 74 of the plurality of support blocks 40, and is maintained thereat, by the set screw 78 of the plurality of support blocks 40 passing freely through an associated threaded blind bore 76 of the plurality of support blocks 40 and then threadably into a threaded bore 82 of an associated distance/stability tube 42.

It will be understood that each of the elements described above, or two or more together, may also find a useful application in other types of constructions differing from the types described above.

While the invention has been illustrated and described as embodiments of a modular cable wine rack system, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A modular rack system for suspending wine bottles at height adjustable levels from between a ceiling and a floor of a room, wherein each wine bottle has a body with a diameter, a top end and a bottom end, said modular rack system comprising:

a) a plurality of cables; and b) a plurality of support blocks;

wherein said plurality of cables extend tautly from the ceiling to the floor of a room;

wherein said plurality of support blocks each have a pair through bores wherein respective pairs of through bores of respective support blocks receive a pair of cable connectors in a height adjustable manner;

wherein said cable connectors each have a blind slot and a blind bore, wherein an associated cable is maintained in an associated blind slot of an associated cable connector by a set screw threadably engaging in the associated blind bore of said associated cable connector to wedge said associated cable between the set screw and the associated cable connector; and wherein corresponding adjacent pairs of said support blocks are adapted to support wine bottles with the body of the wine bottles laying flat in a generally horizontal manner; wherein, when in use, said wine bottles are securely positioned between adjacent support blocks without falling to the ground when said support blocks move vertically along the cables to adjust the height of the support blocks.

2. The modular rack system of claim 1, further comprising a plurality of distance/stability tubes.

3. The modular rack system of claim 2, wherein said support blocks are spaced-apart from each other by a distance; and wherein said plurality of distance/stability tubes extend between adjacent pairs of support blocks and fix said distance between said adjacent pairs of support blocks while adding stability to said adjacent pairs of support blocks.

4. The modular rack system of claim 1, further comprising ceiling anchors; and wherein said ceiling anchors are for attaching said plurality of cables to the ceiling.

5. The modular rack system of claim 4, wherein said ceiling anchors engage upper ends of said plurality of cables.

6. The modular rack system of claim 1, further comprising floor anchors; and wherein said floor anchors are for attaching said plurality of cables to the floor.

7. The modular rack system of claim 6, wherein said floor anchors engage lower ends of said plurality of cables.

8. The modular rack system of claim 1, wherein said plurality of cables are made of steel.

9. The modular rack system of claim 1, wherein said plurality of support blocks are made of wood.

10. The modular rack system of claim 2, wherein at least one pair of said plurality of support blocks together with at least one pair of said plurality of distance/stability tubes form a module.

11. The modular rack system of claim 10, wherein each module is disposed at a specific elevation along said plurality of cables; and wherein each module is for holding up to one less wine bottle than a number of support blocks.

12. The modular rack system of claim 10, wherein each module includes said at least one pair of said plurality of support blocks and said at least one pair of said plurality of distance/stability tubes.

13. The modular rack system of claim 10, wherein said plurality of support blocks of each module are spaced-apart from each other.

14. The modular rack system of claim 10, wherein said plurality of support blocks of each module are horizontally aligned with each other.

15. The modular rack system of claim 10, wherein said plurality of support blocks of each module are parallel to each other.

16. The modular rack system of claim 10, wherein said plurality of support blocks of each module have end faces.

17. The modular rack system of claim 10, wherein said plurality of distance/stability tubes of each module extend between adjacent pairs of support blocks.

18. The modular rack system of claim 16, wherein said plurality of distance/stability tubes of each module are disposed adjacent to said end faces of said plurality of support blocks of an associated module.

19. The modular rack system of claim 10, wherein adjacent pairs of support blocks of each module are spaced-apart from each other a distance less than the diameter of the body of the wine bottle for cradling the wine bottle therebetween.

20. The modular rack system of claim 10, wherein said plurality of distance/stability tubes of each module are spaced-apart from each other.

21. The modular rack system of claim 10, wherein said plurality of distance/stability tubes of each module are horizontally aligned with each other.

22. The modular rack system of claim 10, wherein said plurality of distance/stability tubes of each module are parallel to each other.

23. The modular rack system of claim 10, wherein said plurality of distance/stability tubes of each module are disposed perpendicularly to said plurality of support blocks of an associated module.

24. The modular rack system of claim 10, wherein said plurality of support blocks of each module include at least one intermediate block.

25. The modular rack system of claim 16, wherein said plurality of support blocks of each module include at least two end blocks.

26. The modular rack system of claim 24, wherein each intermediate block of said plurality of support blocks of each module is slender.

27. The modular rack system of claim 24, wherein each intermediate block of said plurality of support blocks of each module is elongated.

28. The modular rack system of claim 24, wherein each intermediate block of said plurality of support blocks of each module is rectangular parallelepiped-shaped.

29. The modular rack system of claim 25, wherein each end block of said plurality of support blocks of each module is slender.

30. The modular rack system of claim 25, wherein each end block of said plurality of support blocks of each module is elongated.

31. The modular rack system of claim 25, wherein each end block of said plurality of support blocks of each module is rectangular parallelepiped-shaped.

32. The modular rack system of claim 25, wherein each end block of said plurality of support blocks of each module has:

a) said end faces;

b) a top face;

c) a bottom face; and d) a pair of side faces.

33. The modular rack system of claim 32, wherein said pair of through bores of each end block of said plurality of support blocks of each module extend from said bottom face of an associated end block of said plurality of support blocks of an associated module to said top face of said associated end block of said plurality of support blocks of said associated module.

34. The modular rack system of claim 32, wherein said pair of through bores of each end block of said plurality of support blocks of each module are disposed near said end faces of an associated end block of said plurality of support blocks of an associated module, respectively.

35. The modular rack system of claim 32, wherein each through bore of each end block of said plurality of support blocks of each module is cylindrical.

36. The modular rack system of claim 33, wherein each through bore of each end block of said plurality of support blocks of each module is axially stepped in three coaxial and progressively narrower diameters as said through bore of an associated end block of said plurality of support blocks of an associated module extends from said bottom face of said associated end block of said plurality of support blocks of said associated module to said top face of said associated end block of said plurality of support blocks of said associated module.

37. The modular rack system of claim 32, wherein said through bore of each end block of said plurality of support blocks of each module has:

a) a widest portion;

b) an intermediate portion; and c) a narrowest portion.

38. The modular rack system of claim 37, wherein said widest portion of said through bore of each end block of said plurality of support blocks of each module originates in said bottom face of an associated end block of said plurality of support blocks of an associated module.

39. The modular rack system of claim 37, wherein said narrowest portion of said through bore of each end block of said plurality of support blocks of each module originates in said top face of an associated end block of said plurality of support blocks of an associated module.

40. The modular rack system of claim 37, wherein said intermediate portion of said through bore of each end block of said plurality of support blocks of each module communicatingly connects said widest portion of said through bore of an associated end block of said plurality of support blocks of an associated module to said narrowest portion of said through bore of said associated end block of said plurality of support blocks of said associated module.

41. The modular rack system of claim 32, wherein each end block of said plurality of support blocks of each module has a pair of blind bores.

42. The modular rack system of claim 41, wherein said pair of blind bores of each end block of said plurality of support blocks of each module extend into one side face of an associated end block of said plurality of support blocks of an associated module.

43. The modular rack system of claim 41, wherein said pair of blind bores of each end block of said plurality of support blocks of each module are disposed just inwardly of said pair of through bores of an associated end block of said plurality of support blocks of an associated module, respectively.

44. The modular rack system of claim 41, wherein said pair of blind bores of each end block of said plurality of support blocks of each module are disposed closer to said bottom face of an associated end block of said plurality of support blocks of an associated module.

45. The modular rack system of claim 25, wherein said pair of blind bores of each end block of said plurality of support blocks of each module are sized to receive said plurality of distance/stability tubes of an associated module.

46. The modular rack system of claim 41, wherein each end block of said plurality of support blocks of each module has a pair of threaded blind bores.

47. The modular rack system of claim 46, wherein said pair of threaded blind bores of each end block of said plurality of support blocks of each module receive a pair of set screws, respectively.

48. The modular rack system of claim 46, wherein said pair of threaded blind bores of each end block of said plurality of support blocks of each module extend into said bottom face of an associated end block of said plurality of support blocks of an associated module.

49. The modular rack system of claim 46, wherein said pair of threaded blind bores of each end block of said plurality of support blocks of each module are disposed just inwardly of said pair of through bores of an associated end block of said plurality of support blocks of an associated module, respectively.

50. The modular rack system of claim 46, wherein said pair of threaded blind bores of each end block of said plurality of support blocks of each module are disposed closer to one side face of an associated end block of said plurality of support blocks of an associated module.

51. The modular rack system of claim 47, wherein said pair of threaded blind bores of each end block of said plurality of support blocks of each module communicate with said pair of blind bores of an associated end block of said plurality of support blocks of an associated module, respectively, so as to allow said pair of set screws of said associated end block of said plurality of support blocks of said associated module to contact and lock said plurality of distance/stability tubes of said associated module into said pair of blind bores of said associated end block of said plurality of support blocks of said associated module, respectively.

52. The modular rack system of claim 41, wherein said pair of blind bores of each intermediate block of said plurality of support blocks of each module extend into both side faces of an associated intermediate block of said plurality of support blocks of an associated module.

53. The modular rack system of claim 41, wherein said pair of threaded blind bores of each intermediate block of said plurality of support blocks of each module are disposed close to said pair of side faces of an associated intermediate block of said plurality of support blocks of an associated module.

54. The modular rack system of claim 2, wherein each distance/stability tube is tubular.

55. The modular rack system of claim 2, wherein each distance/stability tube is hollow.

56. The modular rack system of claim 2, wherein each distance/stability tube is straight.

57. The modular rack system of claim 2, wherein each distance/stability tube is slender.

58. The modular rack system of claim 2, wherein each distance/stability tube is elongated.

59. The modular rack system of claim 46, wherein each distance/stability tube has a pair of ends.

60. The modular rack system of claim 59, wherein each distance/stability tube has a pair of threaded bores.

61. The modular rack system of claim 60, wherein said pair of threaded bores of each distance/stability tube are disposed in close proximity to said pair of ends of an associated distance/stability tube, respectively.

62. The modular rack system of claim 60, wherein said pair of threaded bores of each distance/stability tube are axially aligned.

63. The modular rack system of claim 61, wherein each cable connector has:

a) an axis; and b) a base portion.

64. The modular rack system of claim 63, wherein said base portion of each cable connector is cylindrically shaped.

65. The modular rack system of claim 63, wherein said base portion of each cable connector has an upper face.

66. The modular rack system of claim 63, wherein said base portion of each cable connector has a periphery.

67. The modular rack system of claim 66, wherein said base portion of each cable connector has a lower face.

68. The modular rack system of claim 67, wherein each cable connector has a stub portion.

69. The modular rack system of claim 68, wherein said stub portion of each cable connector is cylindrically shaped.

70. The modular rack system of claim 68, wherein said stub portion of each cable connector has an upper face.

71. The modular rack system of claim 70, wherein said stub portion of each cable connector has a periphery.

72. The modular rack system of claim 68, wherein said stub portion of each cable connector extends coaxially from said base portion of an associated cable connector.

73. The modular rack system of claim 68, wherein said stub portion of each cable connector extends upwardly from said base portion of an associated cable connector.

74. The modular rack system of claim 1, wherein said blind slot of each cable connector extends radially through an associated cable connector.

75. The modular rack system of claim 71, wherein said blind slot of each cable connector extends from said lower face of said base portion of an associated cable connector to said upper face of said stub portion of said associated cable connector.

76. The modular rack system of claim 71, wherein said blind slot of each cable connector extends radially inwardly from said periphery of said base portion of an associated cable connector and from said periphery of said stub portion of said associated cable connector to just past said axis of said associated cable connector.

77. The modular rack system of claim 71, wherein the blind bore of each cable connector is a threaded blind bore.

78. The modular rack system of claim 77, wherein said threaded blind bore of each cable connector extends radially inwardly from said periphery of said base portion of an associated cable connector to said blind slot of said associated cable connector.

79. The modular rack system of claim 77, wherein said threaded blind bore of each cable connector communicates with said blind slot of an associated cable connector.

80. The modular rack system of claim 1, wherein each cable connector sits in an associated through bore of said plurality of support blocks.

81. The modular rack system of claim 77, wherein each distance/stability tube sits in an associated blind bore of said plurality of support blocks.

82. The modular rack system of claim 1, wherein each distance/stability tube is maintained in an associated blind bore of said plurality of support blocks by said set screw of said plurality of support blocks passing freely through an associated threaded blind bore of said plurality of support blocks and then threadably into a threaded bore of an associated distance/stability tube.

* * * * *